US012767373B1

(12) United States Patent
Klingler et al.

(10) Patent No.: US 12,767,373 B1
(45) Date of Patent: Oct. 20, 2026

(54) STACKING MOLD AND STACKING MOLD SYSTEM

(71) Applicant: IFCO SYSTEMS GmbH, Pullach (DE)

(72) Inventors: Nathan Klingler, Tampa, FL (US); Jon Brooks, Tampa, FL (US); Darren Kuzma, Tampa, FL (US); Matt Hopfner, Tamp, FL (US)

(73) Assignee: IFCO SYSTEMS GmbH, Pullach (DE)

( * ) Notice: Subject to any disclaimer, the term of this patent is extended or adjusted under 35 U.S.C. 154(b) by 0 days.

(21) Appl. No.: 19/268,078

(22) Filed: Jul. 14, 2025

(51) Int. Cl.
*B65D 19/02* (2006.01)
*B65B 67/00* (2006.01)
*B65D 19/08* (2006.01)
*B65D 19/18* (2006.01)

(52) U.S. Cl.
CPC ..... *B65B 67/00* (2013.01)

(58) Field of Classification Search
None
See application file for complete search history.

(56) References Cited

U.S. PATENT DOCUMENTS 2,495,711 A * 1/1950 Fletcher ..... B65D 19/385 108/53.5
3,994,241 A * 11/1976 Evans ..... B65D 19/385 108/53.5
2003/0079660 A1* 5/2003 Torrey ..... B65D 19/38 108/51.11
2004/0129699 A1* 7/2004 Williams ..... B65D 11/1873 220/4.31
2013/0320006 A1* 12/2013 Orgeldinger ..... B65D 21/00 220/4.33

FOREIGN PATENT DOCUMENTS

CZ 5556 U1 * 3/1997
EP 4067252 A1 * 10/2022 ..... B65D 81/02

* cited by examiner

*Primary Examiner* — Tanzim Imam
(74) *Attorney, Agent, or Firm* — CHRISTENSEN O'CONNOR JOHNSON KINDNESS PLLC

(57) ABSTRACT

A stacking mold for guiding the stacking of reusable packaging containers on a pallet includes a base configured to be positioned adjacent to the pallet, a back guide extending vertically from the base and configured to provide a rear guide for the containers, and lateral guides extending vertically from the base on opposite sides of the back guide, the lateral guides configured to provide lateral guides for the containers. The stacking mold may include a height indicator to prevent overstacking and a vertical guide positioned off-center on the back guide to guide proper container orientation for optimized pallet loading density. The system addresses common problems in store and warehouse operations including inconsistent stacking neatness, improper height control, and incorrect container orientation that lead to downstream reworking of pallets in supply chain operations.

19 Claims, 9 Drawing Sheets

STACKING MOLD AND STACKING MOLD SYSTEM

BACKGROUND

Reusable packaging containers (RPCs) are widely used in the supply chain for transporting and storing goods, particularly in retail and grocery operations. These containers are typically stacked on pallets for efficient storage and transportation. However, maintaining proper stacking alignment, height control, and orientation consistency presents ongoing challenges in warehouse and retail environments.

Improper stacking of RPCs on pallets can lead to several problems including unstable loads, inefficient use of pallet space, safety hazards during transport and handling, and the need for downstream reworking of pallets to ensure compliance with shipping and storage requirements. Common issues include inconsistent stacking neatness where containers are not properly interlocked, exceeding safe stacking heights, and improper container orientation that reduces pallet loading density.

Current methods for guiding RPC stacking often rely solely on worker training and visual guidelines, which can be inconsistent and prone to human error. There exists a need for a physical guidance system that can help ensure consistent, safe, and efficient stacking of reusable packaging containers on pallets while optimizing space utilization and maintaining load stability.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to an aspect of the invention, a stacking mold for guiding the stacking of reusable packaging containers on a pallet comprises a base configured to be positioned adjacent to the pallet, a back guide extending vertically from the base and configured to provide a rear guide for the containers, and lateral guides extending vertically from the base on opposite sides of the back guide, the lateral guides configured to provide lateral guides for the containers. This system provides physical guidance that ensures consistent stacking alignment and reduces human error in store and warehouse operations.

According to an exemplary embodiment, the lateral guides comprise at least one lateral guide panel. This configuration provides a solid surface for guiding container placement and improves stacking stability.

The lateral guide panel may be made from melamine laminate. This material provides durability and smooth surface contact with containers while being cost-effective.

In another exemplary embodiment, the lateral guides may be made from sheet metal. This construction offers enhanced durability and resistance to wear from repeated container contact. Further, sheet metal allows cost advantages in the manufacturing process as the guides may be formed by stamping and bending.

In another exemplary embodiment, the lateral guides are made from a rod material. This lightweight construction reduces material costs while still providing effective lateral guidance.

According to an exemplary embodiment, the back guide comprises at least one back guide panel. This configuration provides a solid backstop surface for consistent container alignment.

The back guide panel may be made from a melamine laminate. This material selection provides a smooth, durable surface that resists wear and is easy to clean.

In an alternative embodiment, the back guide panel is made from sheet metal. This construction offers superior durability and resistance to impact from container stacking operations. Further, sheet metal allows cost advantages in the manufacturing process as the guides may be formed by stamping and bending.

In a yet further exemplary embodiment, the back guide may be made from a rod material. This lightweight design reduces manufacturing costs while maintaining effective guidance functionality.

The stacking mold may comprise a height indicator. This feature prevents overstacking and ensures compliance with safe stacking height requirements.

The height indicator may comprise a horizontal rod mounted to at least one of the lateral guides. This configuration provides a clear visual and physical indication of maximum stacking height.

According to an alternative embodiment, the height indicator may comprise a horizontal tab mounted to the back guide. This design integrates the height indication directly into the back guidance structure for space efficiency.

According to an exemplary embodiment, the stacking mold further comprises a vertical guide mounted to the back guide. This feature guides proper container orientation to optimize pallet loading patterns.

The vertical guide may be positioned off-center to guide proper orientation of the containers on the pallet. This asymmetric positioning ensures containers are placed in the correct orientation for maximum pallet utilization.

The vertical guide may be configured to guide stacking of containers in alternating orientations to optimize pallet loading density. This arrangement maximizes the number of containers that can be efficiently loaded on each pallet.

According to an exemplary embodiment, the vertical guide is positioned approximately 24 inches from one lateral guide and approximately 16 inches from the other lateral guide. This specific positioning accommodates the footprint of standard reusable packaging containers for optimal loading patterns.

The vertical guide may be formed as a rib. This construction provides effective guidance while minimizing material usage and manufacturing complexity.

According to an exemplary embodiment, the stacking mold is dimensioned to accommodate pallets having dimensions of approximately 40 inches by 48 inches. This sizing ensures compatibility with standard pallet dimensions commonly used in supply chain operations.

In an aspect of the invention, at least one of the back guide and the lateral guides is formed from a plate-like element, and the system further comprises instructional graphics affixed to the plate-like element. These graphics provide visual instructions that enhance worker understanding and compliance with proper stacking procedures.

According to an exemplary embodiment, the base comprises at least one plate-like tab extending into the space defined between the back guide and the lateral guides. The stacking mold is usually placed on a shop floor, and a pallet is placed within the stacking mold so that the back guide extends along one of the sides of the pallet and the lateral guides extend over part of the adjacent sides of the pallet.

The pallet rests on the tab so that the weight of the pallet adds to the stability of the stacking mold, preventing the stacking mold from tipping over when reusable packaging containers impinge on a lateral guide and/or a back guide.

The invention also comprises a stacking mold system having a stacking mold as defined above, and a pallet which is placed adjacent the stacking mold so that the stacking mold provides lateral guidance for reusable packaging containers stacked on the pallet.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
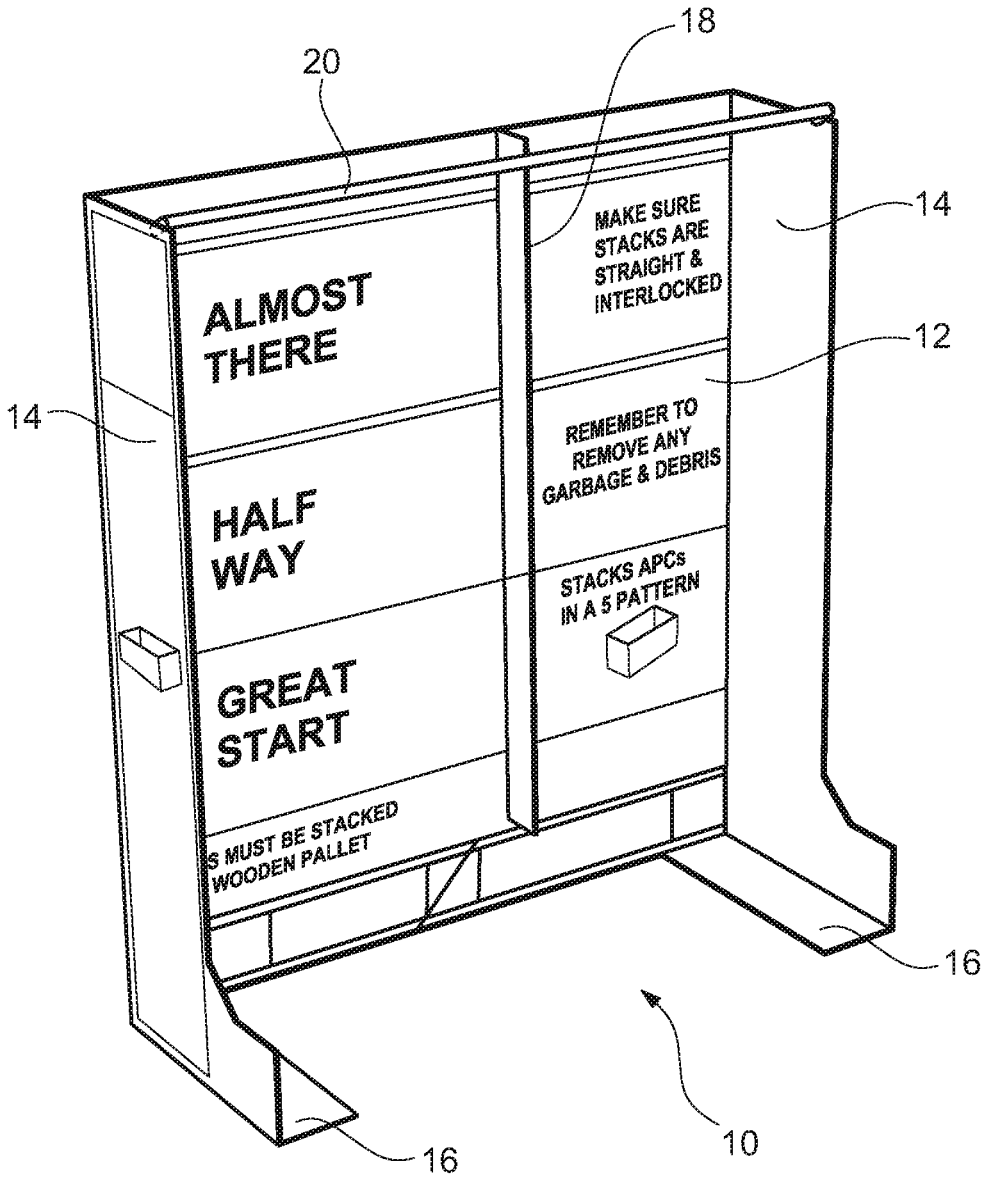
FIG. 1 shows a perspective view of an embodiment of a stacking mold with instructional graphics.
Figure 2:
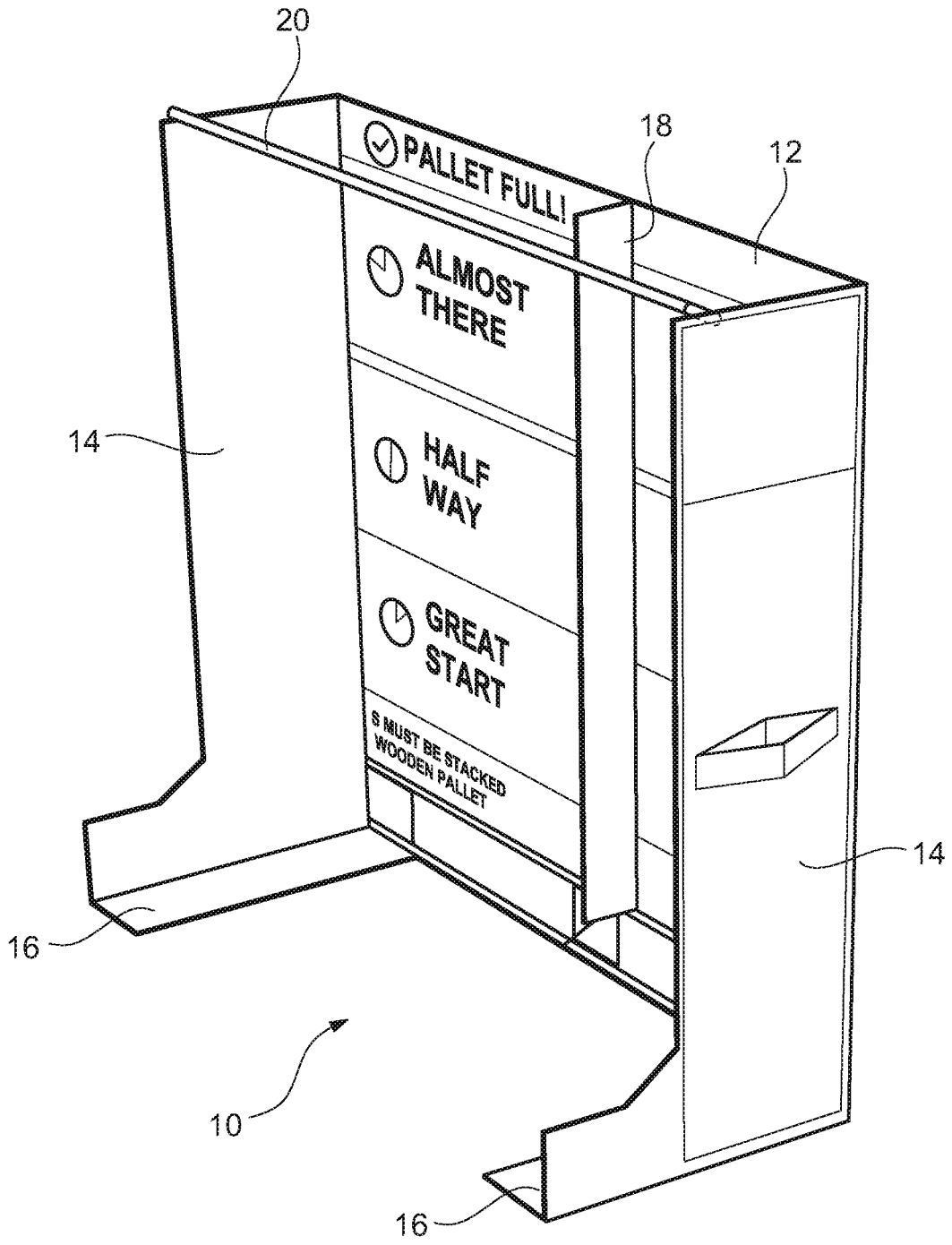
FIG. 2 shows a perspective view of the stacking mold of FIG. 1.

FIGS. 1 and 2 show a perspective view of an embodiment of a stacking mold 10. The stacking mold 10 comprises a back guide 12 which in use extends in a vertical direction. Two lateral guides 14 extend from two opposing lateral edges of the back guide 12.

Each lateral guide 14 is provided with a foot 16 which provides support for the stacking mold and is intended to be placed, in use, on a floor.

The back guide 12 is provided with a vertical guide 18 which extends in a direction which is parallel to the planes in which the lateral guides 14 extend.

A height indicator 20 is provided at the upper edge of the lateral guides 14 in the form of a rod extending from one lateral guide 14 to the other one.

Figure 3:
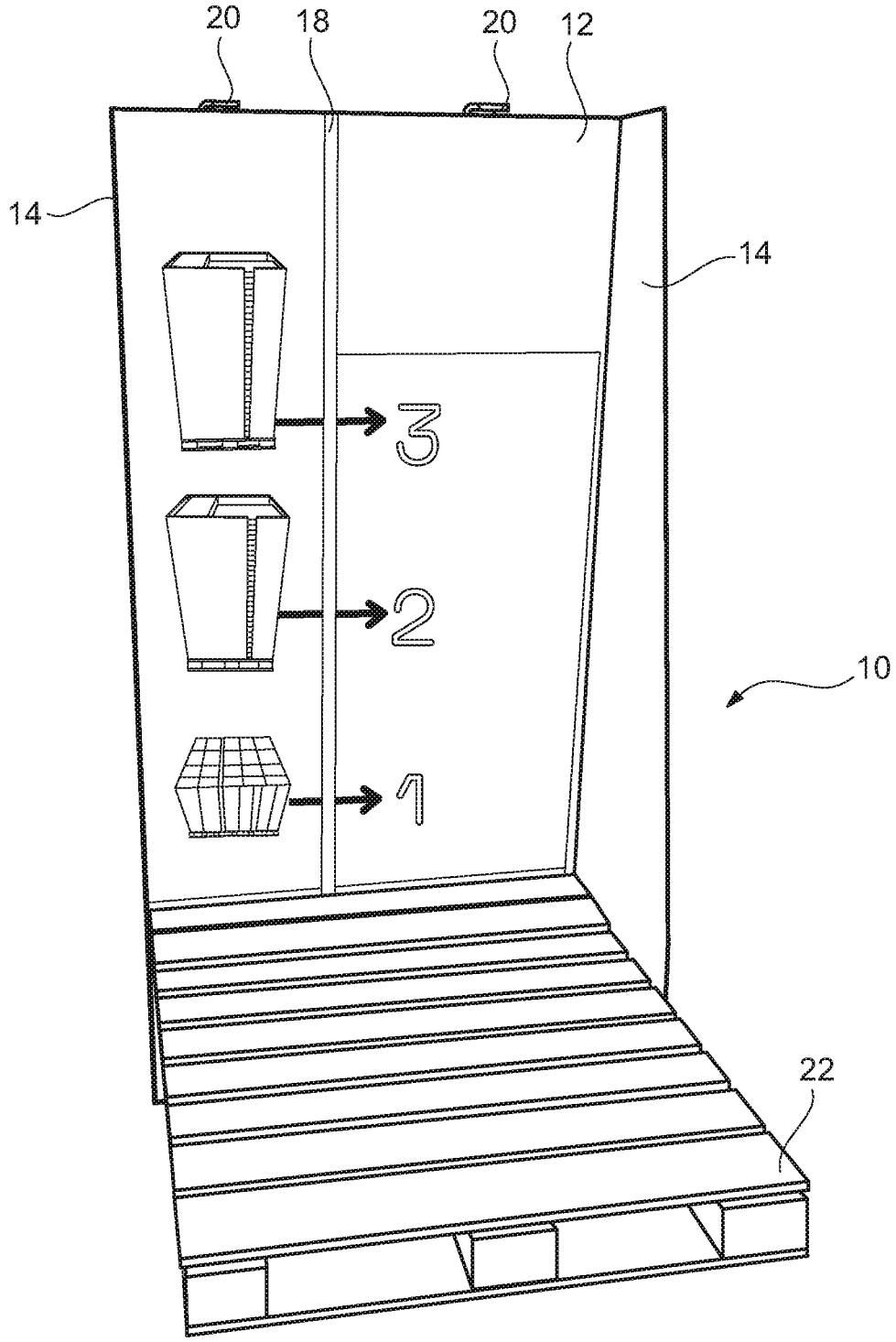
FIG. 3 shows a perspective view of a stacking mold system formed from a stacking mold and a pallet.

A slightly different embodiment of the stacking mold 10 is shown in FIG. 3. Here, a pallet 22 is placed within the space defined by the back guide 12 and the lateral guides 14. The pallet 22 is placed on the feet 16 so as to add, with its weight, to the stability of the stacking mold and prevents it from easily falling over.

It can be seen in FIG. 3 that the back guide 12 and the lateral guides 14 act as a guidance for items placed on the pallet 22, constraining the sideways movement of the items during stacking and ensuring proper alignment within the pallet footprint. The items to be placed on the pallet are reusable packaging containers. These typically have standardized sizes. The vertical guide 18 is placed such that a desired orientation of the containers on the pallet 22 is predefined.

It is particularly advantageous if the vertical guide 18 is arranged offset from a middle plane so that the ratio of the distances from the vertical guide 18 to the two lateral guides is 1:1.5.

The stacking mold 10 is here provided with instructional graphics, which provide visual guidance to workers on proper stacking procedures. The graphics include height indicators showing "ALMOST THERE," "HALF WAY," and "GREAT START" to communicate stacking progress and help maintain consistent stacking heights.

The height indicator 20 is here formed from two tabs provided at the upper edge of the back guide 12. They provide both a visual and physical indication of the maximum safe stacking height for containers. The combination of the back guide 12, lateral guides 14, and height indicator 20 creates a three-dimensional guidance framework that ensures consistent container placement and prevents overstacking, thereby improving pallet stability and reducing the need for downstream reworking of pallets.

The instructional graphics on the back guide are clearly visible and provide step-by-step visual guidance for proper RPC stacking procedures. The graphics include numbered steps showing the progression from initial container placement through final pallet completion, with specific instructions for maintaining proper stacking patterns and height control. This configuration creates a comprehensive guidance system that addresses the common problems of inconsistent stacking neatness, improper height control, and incorrect container orientation that lead to downstream reworking of pallets in supply chain operations.

Figure 4:
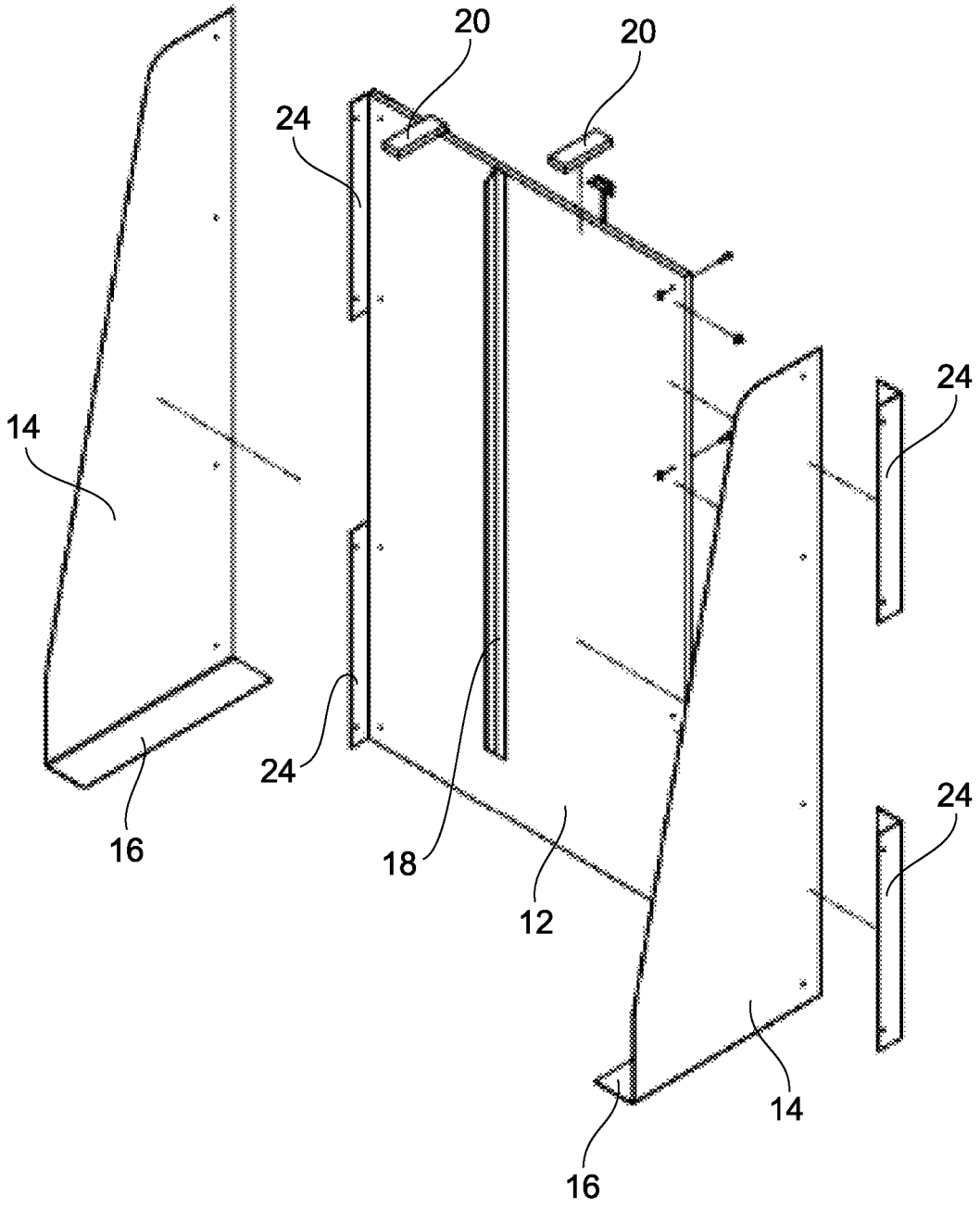
FIG. 4 shows an exploded view of the components of the stacking mold of FIG. 3.
Figure 5:
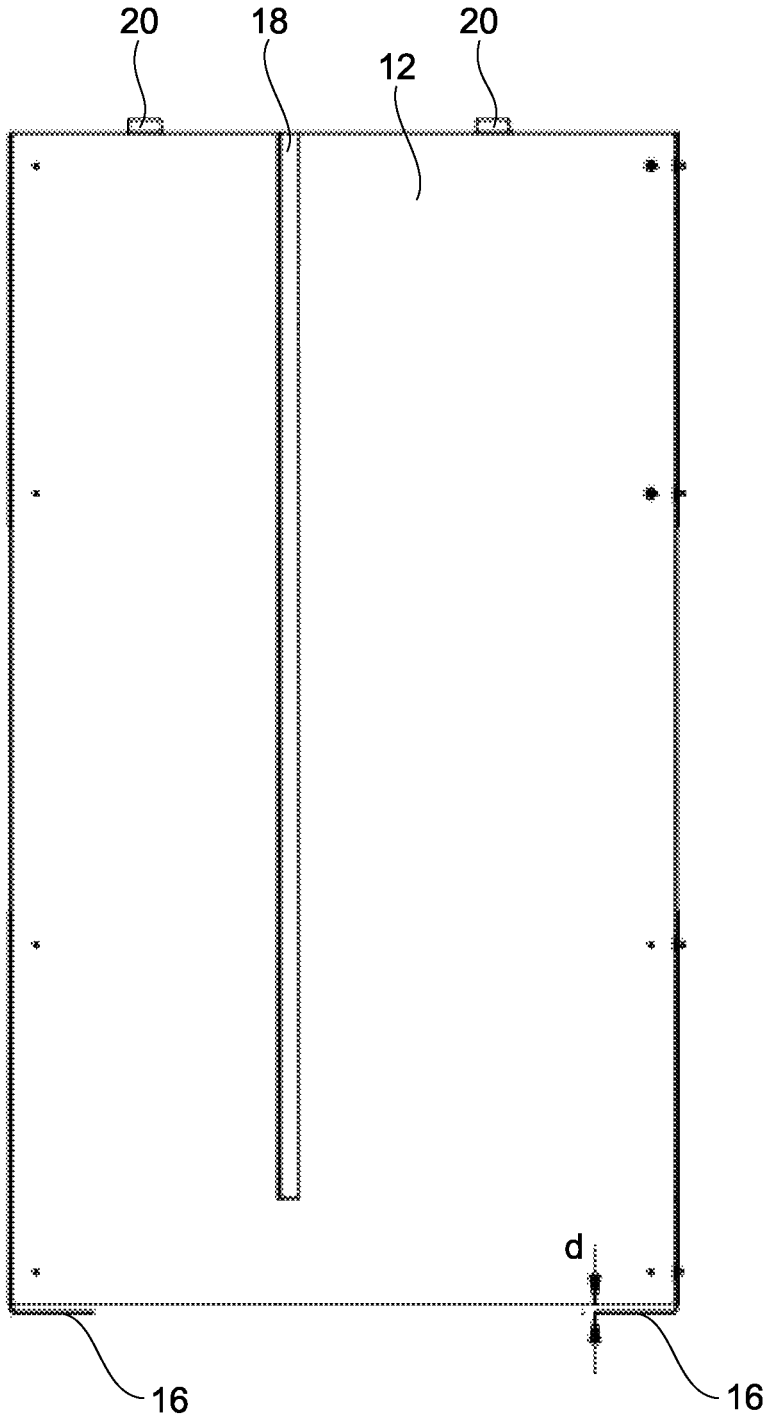
FIG. 5 shows a front view of the stacking mold of FIG. 3.
Figure 6:
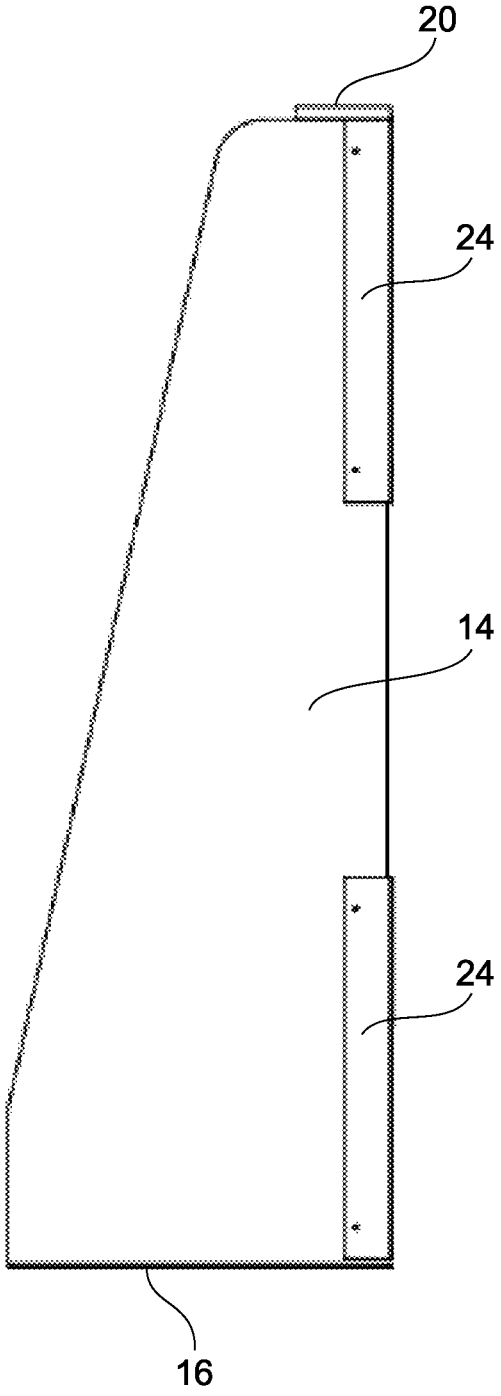
FIG. 6 shows a side view of the stacking mold of FIG. 3.

FIGS. 4 to 6 show the construction of the stacking mold 10 of FIG. 3 in greater detail.

The back guide 12 and the lateral guides 14 have the physical shape of guide panels and can be formed from sheet metal. The feet 16 are formed integrally with the lateral guides 14 and are bent from their lower edges.

The vertical guide 18 is connected to the back guide, for example by glueing.

The height indicator can also be glued to the back guide 12.

Mounting brackets 24 are provided for mechanically connecting the lateral guides 14 to the back guide 12. Screws and nuts can be used for connecting the lateral guides 14 to the back guide 12. Each mounting bracket consists of two material strips connected together at a 90° angle.

It can be seen in FIG. 5 that the lower edge of the back guide 12 terminates at a small distance d above the floor level when that stacking mold 10 is properly mounted. In order to prevent any interference with the pallet to be placed within the stacking mold, the vertical guide 18 terminates at a distance from the lower edge of the back guide 12 which is slightly larger than the height of the pallet.

Figure 7:
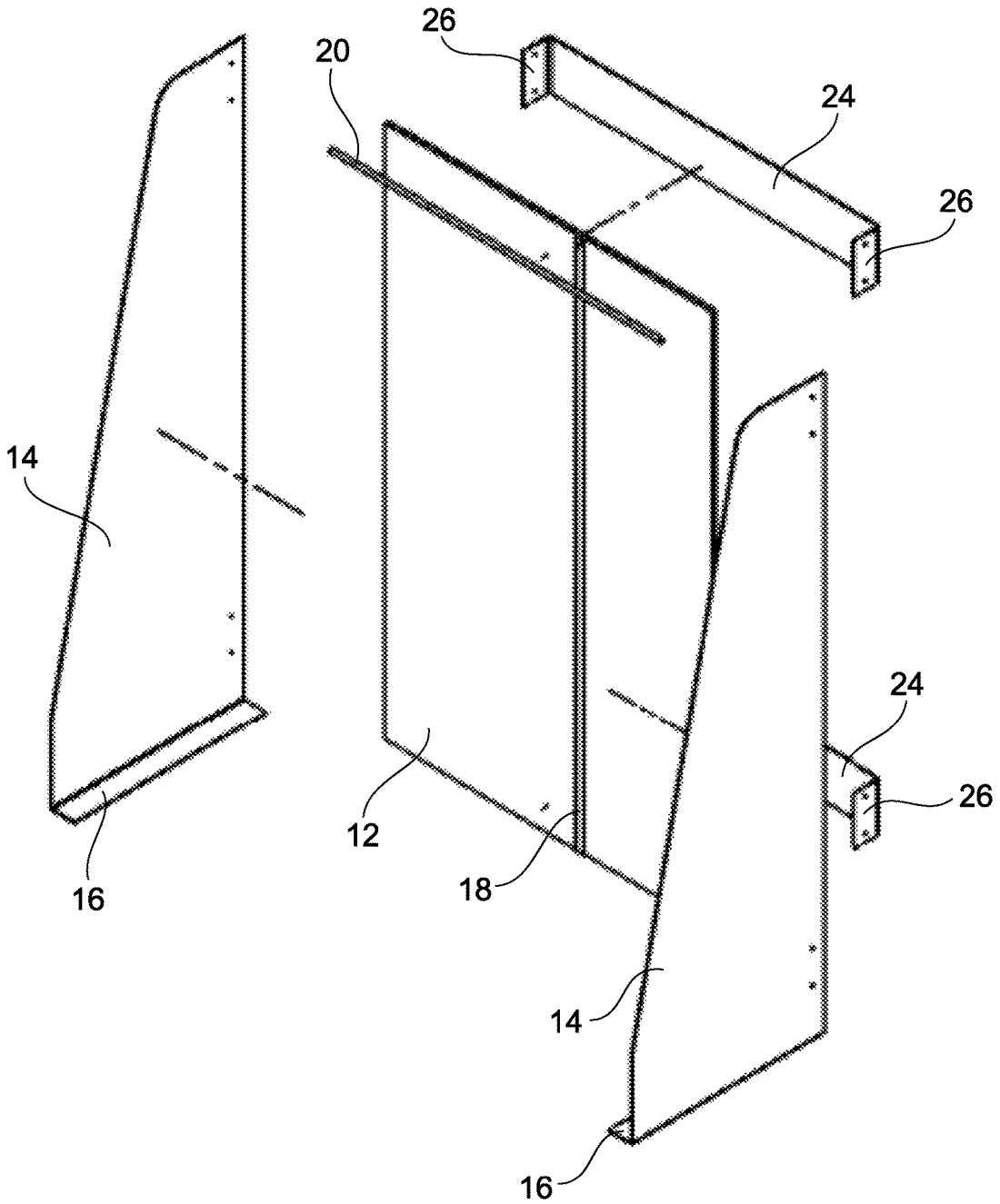
FIG. 7 shows an exploded view of an alternative embodiment of the stacking mold.
Figure 8:
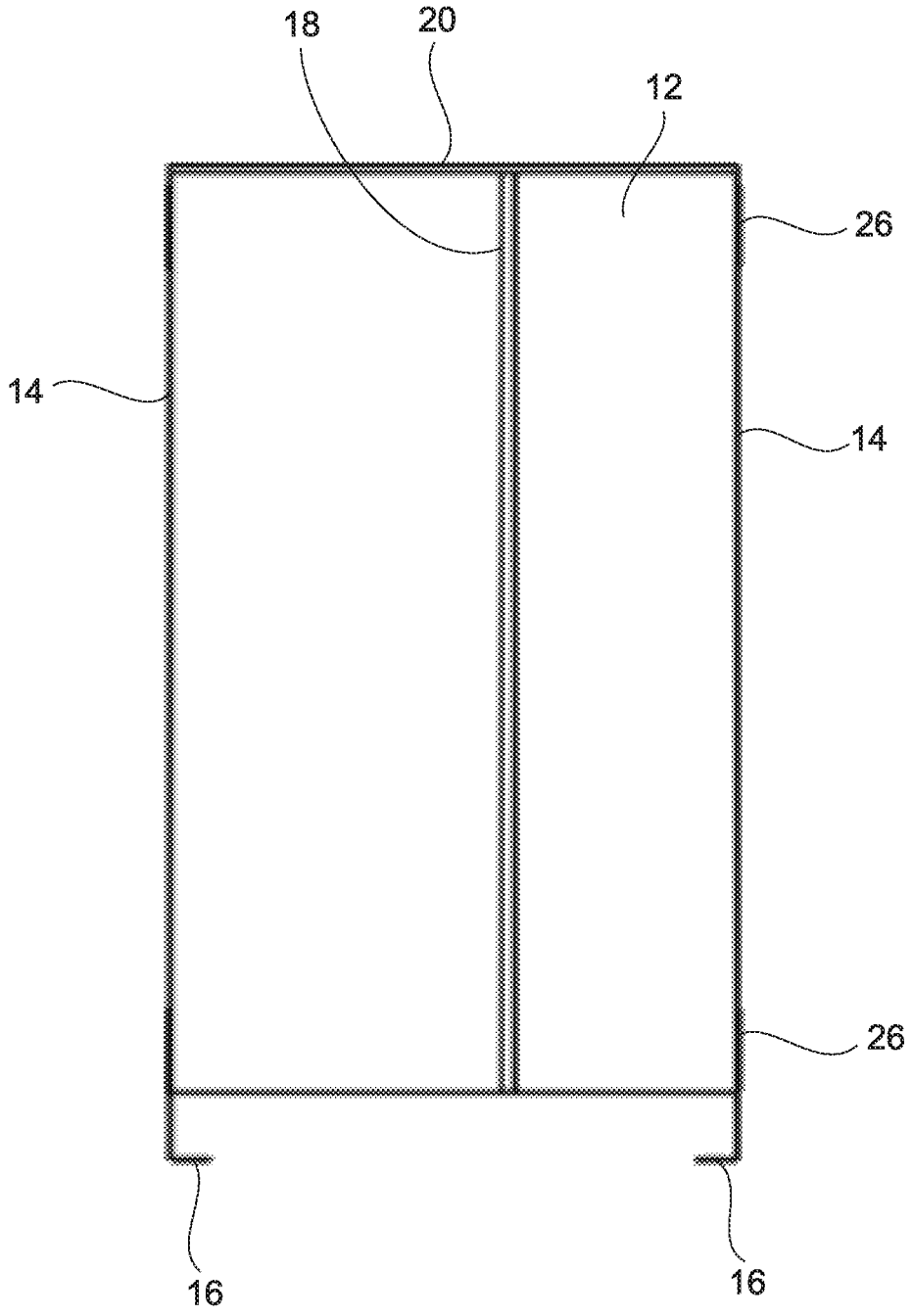
FIG. 8 shows a front view of the stacking mold of FIG. 7.
Figure 9:
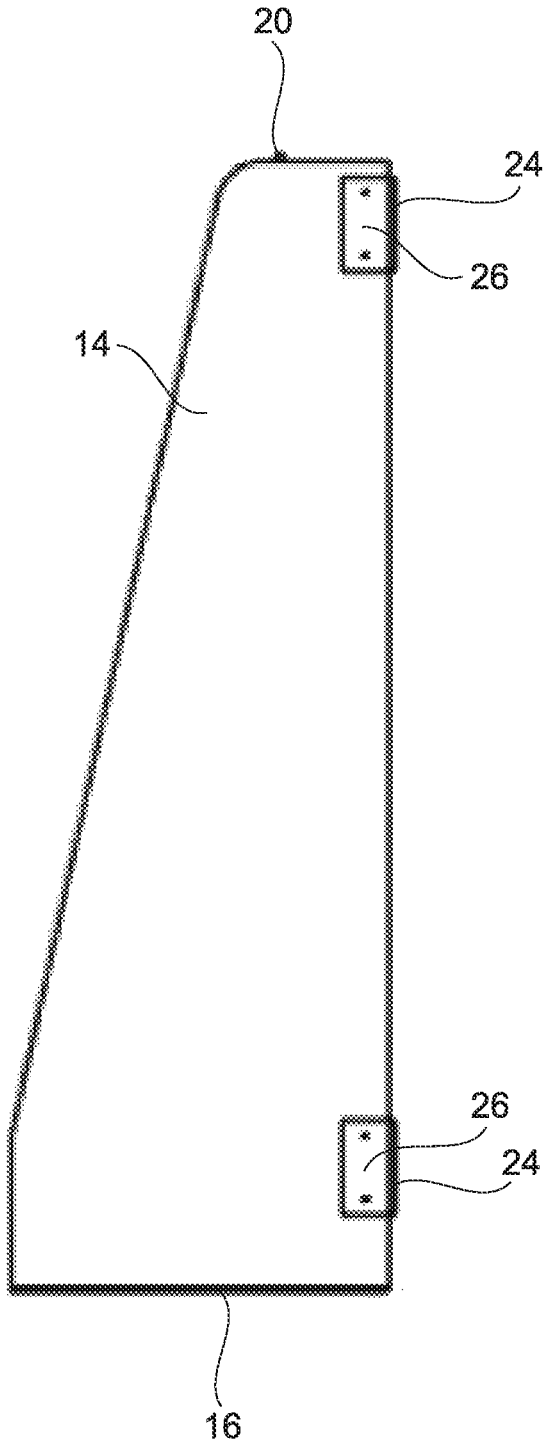
FIG. 9 shows a side view of the stacking mold of FIG. 7.

An alternative embodiment of the stacking mold 10 is shown in FIGS. 7 to 9. For the features known from the previous embodiment, the same reference numerals are being used, and reference is made to the above comments.

In the embodiment of FIGS. 7 to 9, the mounting brackets 24 extend over the entire width of the back guide 12 and have short 90° tabs 26 at their ends.

If desired, the mounting brackets 24 can be used to also connect the vertical guide 18 to the back guide 12.

As visible in FIG. 8, the lower edge of the back guide 12 terminates here at a larger distance above the floor. The vertical guide 18 can thus extend all the way down to the lower edge of the back guide 12.

As an alternative to sheet metal, plastic or composite materials can be used for forming the panels which form the back guide 12, the lateral guides 14 and the vertical guide 18. As an example, a melamine laminate can be used.

As a still further alternative, the back guide 12, the lateral guides 14 and the vertical guide 18 can be formed by rods placed such that the desired guidance for the containers is achieved despite not having a closed guiding surface as provided from panels.

The stacking mold 10 can be used free-standing, with the pallet 22 adding to its stability. It is also possible to use an adhesive for glueing the feet 16 to the floor. In a still further alternative, the feet 16 can be provided with mounting holes which allow the use of bolts for securing the stacking mold 10 to the shop floor.

The invention claimed is:

1. A stacking mold for guiding stacking of reusable packaging containers on a pallet, the mold comprising:

a base configured to be positioned adjacent to the pallet;

a back guide extending vertically from the base and configured to be a rear guide for the containers;

lateral guides extending vertically from the base on opposite sides of the back guide, the lateral guides configured to be lateral guides for the containers; and a vertical guide mounted to the back guide, wherein the vertical guide is positioned off-center to guide proper orientation of the containers on the pallet, and wherein the vertical guide is positioned 24 inches from one of the lateral guides and 16 inches from another of the lateral guides.

2. The stacking mold of claim 1, wherein the lateral guides comprise at least one lateral guide panel.

3. The stacking mold of claim 2, wherein the at least one lateral guide panel is made from a melamine laminate.

4. The stacking mold of claim 2, wherein the at least one lateral guide panel is made from sheet metal.

5. The stacking mold of claim 1, wherein the lateral guides are made from a rod material.

6. The stacking mold of claim 1, wherein the back guide comprises at least one back guide panel.

7. The stacking mold of claim 6, wherein the at least one back guide panel is made from a melamine laminate.

8. The stacking mold of claim 6, wherein the at least one back guide panel is made from sheet metal.

9. The stacking mold of claim 1, wherein the back guide is made from a rod material.

10. The stacking mold of claim 1, further comprising a height indicator.

11. The stacking mold of claim 10, wherein the height indicator comprises a horizontal rod mounted to at least one of the lateral guides.

12. The stacking mold of claim 10, wherein the height indicator comprises a horizontal tab mounted to the back guide.

13. The stacking mold of claim 1, wherein the vertical guide is configured to guide stacking of the containers in alternating orientations to optimize pallet loading density.

14. The stacking mold of claim 1, wherein the vertical guide is formed as a rib.

15. The stacking mold of claim 1, wherein the mold is dimensioned to accommodate pallets having dimensions of 40 inches by 48 inches.

16. The stacking mold of claim 1, wherein at least one of the back guide and the lateral guides is formed from a plate-like element, the mold further comprising instructional graphics affixed to the plate-like element.

17. The stacking mold of claim 1, wherein the base comprises at least one plate-like tab extending into a space defined between the back guide and the lateral guides.

18. A stacking mold system comprising a stacking mold as defined in claim 1 and a pallet placed within the stacking mold.

19. A stacking mold for guiding stacking of reusable packaging containers on a pallet, the mold comprising:

a base configured to be positioned adjacent to the pallet;

a back guide extending vertically from the base and configured to be a rear guide for the containers; and lateral guides extending vertically from the base on opposite sides of the back guide, the lateral guides configured to be lateral guides for the containers;

wherein at least one of the back guide and the lateral guides is formed from a plate-like element, the mold further comprising instructional graphics affixed to the plate-like element, the instructional graphics providing step-by-step visual guidance for proper stacking procedures.

* * * * *